US005357761A

United States Patent [19]

Schauer

[11] Patent Number: 5,357,761

[45] Date of Patent: Oct. 25, 1994

[54] UNIVERSAL THERMAL INSERT FOR BEVERAGE CONTAINERS

[76] Inventor: Curtis S. Schauer, 49 Rock Harbor W., Foster City, Calif. 94404

[21] Appl. No.: 130,363

[22] Filed: Oct. 1, 1993

[51] Int. Cl.[5] ..... F25D 3/00

[52] U.S. Cl. ..... 62/56; 62/530; 62/457.3; 62/372

[58] Field of Search ..... 62/529, 530, 457.2, 62/457.3, 457.4, 293, 372

[56] References Cited

U.S. PATENT DOCUMENTS

| | | | |
|---|---|---|---|
| D. 204,153 | 3/1966 | Tampone | 62/293 |
| 1,944,726 | 1/1934 | Aiken | 62/293 |
| 2,039,736 | 5/1936 | Munters et al. | 62/530 |

FOREIGN PATENT DOCUMENTS

| | | | |
|---|---|---|---|
| 452422 | 5/1913 | France | 62/530 |

*Primary Examiner*—John M. Sollecito

[57] ABSTRACT

An improved method to provide cooling properties to common beverage containers or sport water bottles is described. Specifically, a thermal cooling insert is universally applicable for use in many such containers used by outdoors, bicycle and fitness enthusiasts. The thermal insert is comprised of a molded polyethylene hollow tube filled with a safe, non-toxic refrigerant material which imparts cooling benefit to beverages held inside the container for extended periods of time. The refrigerant material is hermetically sealed inside the tube. The insert includes a flexible "spring loading" stabilizing assembly system which allows simple insertion into and removal from the container and effectively holds the insert in place during use. A shock absorbing assembly may be incorporated into the bottom of the insert to help hold the insert in place, cushion the insert and reduce rattling during use. A stem section with tab grips is designed to facilitate insertion and removal and to fit in both large and small containers.

6 Claims, 4 Drawing Sheets

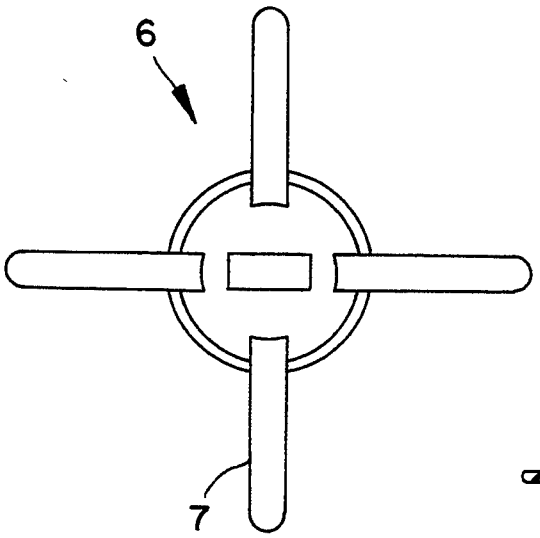
FIG. 2
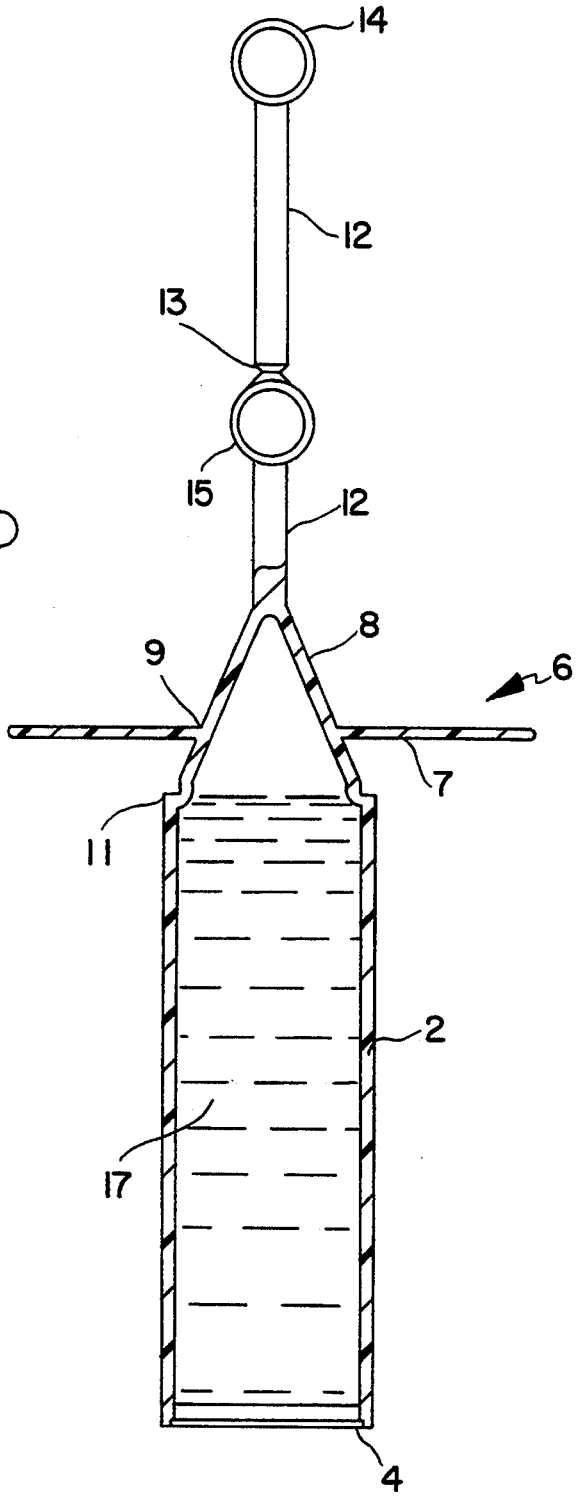
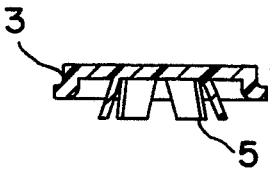
FIG. 3
FIG. 1

UNIVERSAL THERMAL INSERT FOR BEVERAGE CONTAINERS

BACKGROUND OF INVENTION

1. Field of the Invention

This invention relates to a removable, reusable thermal insert designed to impart cooling properties to and is universally applicable to many standard beverage containers such as common sport water bottles.

2. Description of Prior Art

Outdoors and fitness enthusiasts commonly use plastic molded beverage containers to carry water or other soft drinks to refresh thirst and replenish fluids during activities such as bicycling, hiking, walking, running or aerobic exercise. Many users find cool fluids more refreshing. Recent exercise physiology studies also indicate that cool fluids are absorbed more readily by the body and may help control thermal regulatory activity.

Common approaches to maintain cool temperature in contained fluids include external insulation such as cloth, foam, neoprene or other like materials. Another method to keep fluids cool is to surround the container with an enclosure filled with a fluid or material which can be frozen such as disclosed in U.S. Pat. Nos. 4,183,226, 4,338,795, 4,383,422, and 4,932,225 (reference U.S. Pat. No. 5,129,238). These designs make it difficult to carry the container during outdoor activities and do not fit many standard sport water bottles or bicycle water bottle cages.

U.S. Pat. No. 4,741,176 describes another approach comprising a sealed container incorporating a tube filled with a refrigerant material which imparts cooling properties to the fluid in the container. Similar containers are disclosed in U.S. Pat. Nos. 4,981,022 and 5,129,238. In the invention described in U.S. Pat. No. 4,981,022 a plastic tube filled with a non-toxic thermal cooling material is sealed and welded to the base of the inside of the beverage container. This requires the user to purchase the entire bottle/cooler system. In addition, the entire bottle/cooler system must be placed in a freezer to freeze the coolant. This requires space and puts the bottle through numerous freeze/thaw cycles which reduce the life of the container. In the latter invention, a refrigerant material is enclosed in a plastic tube. The tube is designed with threads to fit into the cap of the container. The tube can be removed from the container and cap, can be frozen, then can be replaced in the cap and container to impart cooling properties to the beverage in the container. Again, the customer is limited to using the bottle designed by the manufacturer. In addition, the container does not fit well in many common bike bottle cages. And the tube is not designed to fit in many commonly used sport bottles. Assembly and disassembly of the bottle/cap/tube system is cumbersome and requires multiple steps to accomplish. In many of the inventions an aqueous mixture of water, urea and propylene glycol or water and propylene glycol is used as the refrigerant solution.

Most outdoors, bicycle and fitness enthusiasts already own multiple sport water bottles. A universally applicable removable, reusable thermal insert is needed which can be purchased independent of a proprietary container system is an improved method to cool beverages in containers for extended periods of time. The insert should be designed to fit snugly in the bottle to minimize movement and raffling during use. The insert should also provide cooling while minimizing volume of fluid displaced.

BRIEF DESCRIPTION OF DRAWINGS

The following drawings are referenced in the detailed description of the invention.

FIG. 1 is a sectional view of the insert including tube filled with refrigerant material, flexible stabilizing assembly and stem with multiple grips.

FIG. 2 is a top view of the insert and flexible stabilizing assembly.

FIG. 3 is a sectional view of the plug used to seal the heat exchange material inside the tube. This also provides a sectional view of the shock absorbing assembly incorporated into the bottom of the plug.

SUMMARY OF THE INVENTION

This invention is a thermal insert which is designed to fit in many common beverage containers such as those used by outdoors and bicycle enthusiasts. When frozen and placed in a container, the insert will keep beverages cool for extended periods of time. The device described in this disclosure is an improvement on the designs described above in that it is removable, reusable and is universally applicable to many container designs. It can be used in bottles already owned by many individuals and does not require purchase of a complete bottle/cooler system. The insert displaces less than 40% of the fluid inside inside the container and can be inserted and removed from the container in a single step.

The described device incorporates a molded insert produced from polyethylene. Density of the polymer used in manufacturing can be varied to impart the desired flexibility and strength characteristics required for specific applications. A hollow tube section of the insert is filled with a safe, non-toxic refrigerant material to impart the desired cooling properties. A variety of acceptable materials are available. The preferred material is a proprietary non-toxic thermal hydrogel formulation. The tube is designed to fit with a polyethylene plug to hermetically seal the refrigerant inside.

A flexible stabilizing assembly is used to hold the insert in place during use. The assembly flexes to fit through the opening of bottles during insertion and removal and locks in place during use. The assembly is designed to accommodate many common beverage containers and sport bottles. The stabilizing assembly is a broad aspect of the invention and a variety of methods may be used to accomplish the desired flexible "spring loading" functionality. Another aspect of the device is a flexible shock absorbing assembly which may be included in the design to help hold the insert in place and to reduce rattling inside the container during use. A stem with multiple grip tabs allows easy insertion into and removal from the container. The stem may be cut along its length to fit in different container sizes.

DETAILED DESCRIPTION OF THE INVENTION AND IMPLEMENTATION OF THE METHOD

The reference numbers used throughout this detailed description refer to the same elements in all figures.

Figure 5:
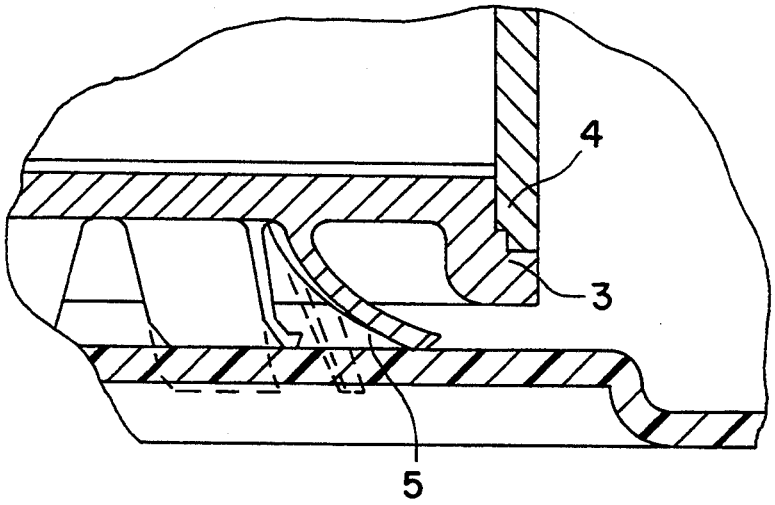
FIG. 5 is an expanded sectional view of the cap and shock absorbing assembly in FIGS. 3 and 4.
Figure 6:
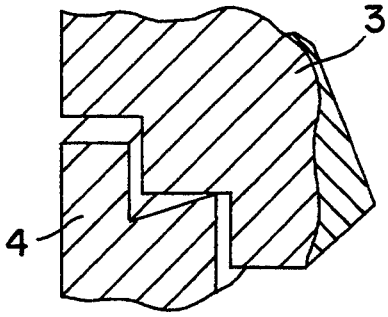
FIG. 6 is a sectional view of a "mash joint" ultrasonic weld (reference technical literature, Herrmann Ultrasonics, Schaumburg, Ill.) which is an alternative to the "sheer joint" design defined in FIG. 5.
Figure 7:
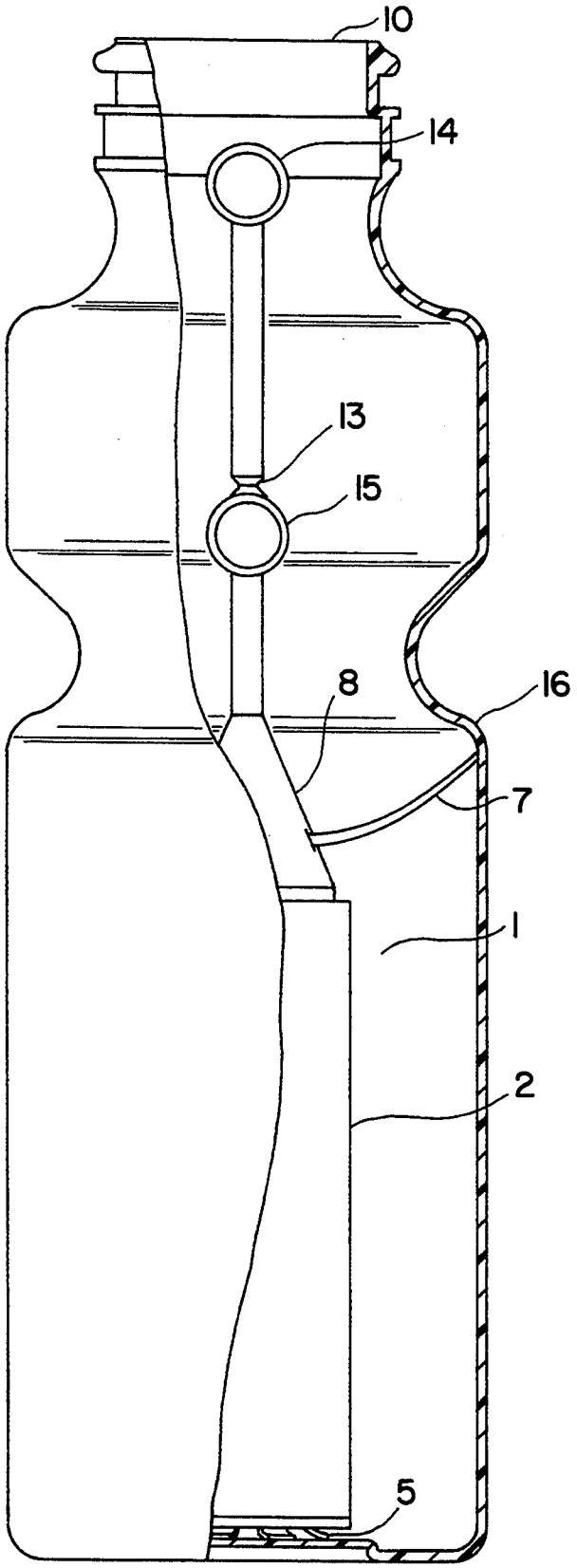
FIG. 7 is a sectional view of the completed insert fit in a common 28 ounce sport bottle.

FIG. 7 is an illustration of the assembled thermal cooling insert 1 situated inside a 28 ounce sport bottle. As seen in FIG. 1 an injection molded polyethylene tube 2 filled with a non-toxic refrigerant material 17 is incorporated into the main body of the insert. In the preferred method, a proprietary thermal hydrogel formulation is used as the refrigerant. The diameter and height of the tube section is defined by optimum combination of cooling properties and fluid displacement inside the bottle. The preferred method utilizes less than 40% of the volume inside the container while providing thermal properties for extended periods of time depending on ambient thermal and sunlight conditions. The preferred tube is ¾" to 2" in diameter. Height (including tapered section of tube) is 2½" to 8". The tube is sealed with a plug 3. In the preferred manufacturing method, the plug 3 shown in FIG. 3 is ultrasonically welded to the wall 4 at the opening of the tube shown in FIG. 1. An optional ledge 11 is incorporated into the design to help hold the insert in a fixture during the welding operation. The tube opening and plug combination are designed to provide a sheer weld joint. FIG. 5 shows detail of a welded joint. Another common alternative weld design, the "mash joint" is illustrated in FIG. 6. An O-ring many be placed around the inner surface of the tube to provide an additional seal.

A flexible stabilizing fin assembly 6 as shown in FIGS. 1 and 2 is designed to flex to fit through the mouth opening and variations in wall diameter of common beverage containers during insertion and removal. The assembly is designed to rebound to hold the insert against the sides of the bottle and hold the insert in place during use. The stabilizing assembly is defined by a set of discrete fins 7 as shown in FIG. 1 sectional view and FIG. 2 top view, which radiate concentrically from the sides of the insert to touch the sides of the bottle wall, thus holding the insert in place inside the container. The shape, number, length, width and depth dimensions of the fins as well as their vertical, horizontal and angular orientation with respect to the sides of the insert tube or stem which comprise the assembly can be designed to achieve the desired stabilizing effect in use..A single assembly can be used or multiple assemblies can be designed into the insert at various points along the perimeter of the tube or stem to optimize the fit, insertion and removal characteristics of the insert. As shown in FIG. 1, the preferred method incorporates a single stabilizing fin assembly 6 with four fins radiating concentrically from a tapered section of the tube 8. The width of the fins lie along the horizontal axis as noted in the top view of the assembly, FIG. 2. In the preferred method, the tip-to-tip dimension is 2⅞" to 6½" across. This dimension should be greater than the diameter of the beverage container in use. The distance of the assembly from the bottom of the insert along the vertical axis in FIG. 1 is defined to fit the assembly and fins snugly along the sides of the shoulder radius of the container 16 as shown in FIG. 7. In the preferred method, the fins are placed at a location between 2" and 6½ from the bottom-most point of the insert.

The angle of the tapered tube section 8 in FIG. 1 is defined to provide optimum radius 9 from which to begin the extension of the fins from the side of the tube. If the fin assembly is placed along the tube or stem at a point where the tube radius is too small, the fins will be too flexible and will not effectively hold the insert in place during use. If the fin assembly is placed along the tube or stem at a point where the radius is too large, the fins will be too rigid and will not flex adequately to allow insertion through the mouth of the beverage container 10 (see FIG. 7). In the preferred method, the tapered section begins at a point from 1½" to 5½" from the bottom of the insert with a diameter of ¾" to 2". It ends at a point from 3" to 7½" from the bottom of the insert with a diameter of ⅛" to ¾". The fin assembly protrudes from the insert at a point where the diameter is between ⅛" and 2". An alternative to the tapered section is an indentation or notch in the sides of the tube which provides the optimum radius at the location of the stabilizing assembly. The disadvantage of this method is that it limits the volume inside the tube available for the thermal material. In this scenario, injection molding limits the diameter of the hollow tube beyond this point to the tube diameter required for optimum fin assembly placement. The tapered tube maximizes the volume of thermal material while optimizing tube diameter for fin flexibility.

Figure 4:
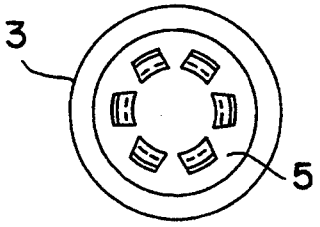
FIG. 4 is a bottom view of the cap and shock absorbing assembly shown in FIG. 3.

As seen in FIGS. 3 and 4, a set of flexible vertical fins 5 are designed into the bottom of the plug to comprise a shock absorbing assembly which rests on the bottom of the container while in use. These are not required. But, when used in conjunction with the flexible stabilizing fin assembly 6 described above and shown in FIGS. 1 and 2, the shock absorbing fins help hold the insert in place and reduce movement and rattling while in use. In the preferred design, six fins protrude at a slight outward angle from vertical at point of intersection of the bottom of the plug and rest on the bottom of the container. The preferred angle is in the range from 0 degrees to 80 degrees and length of the fins are defined such that they do not extend greater than the diameter of the plug. The length, thickness and angle of the fins used in the assembly design can be varied to achieve the desired flexibility, strength and fit inside the beverage containers. In the preferred method, these parameters are adjusted to fit the stabilizing assembly fins 7 into the shoulder radius 16 of the side of common beverage containers. See FIGS. 7 and 8 for an illustration of this effect. During use the beverage container experiences vibration and movement. The shock absorbing assembly serves to help hold the insert in place and adds friction between the insert and the bottom of the container while in use. The fins 5 flex during vibration and reduce contact between the tube 2 and the bottom and sides of the beverage container. An additional horizontal stabilizing fin assembly of any length from 1/32" to 6" can be incorporated into the bottom of the tube or plug in conjunction with or instead of the vertical shock absorbing fin assembly to achieve the desired functionality.

Figure 8:
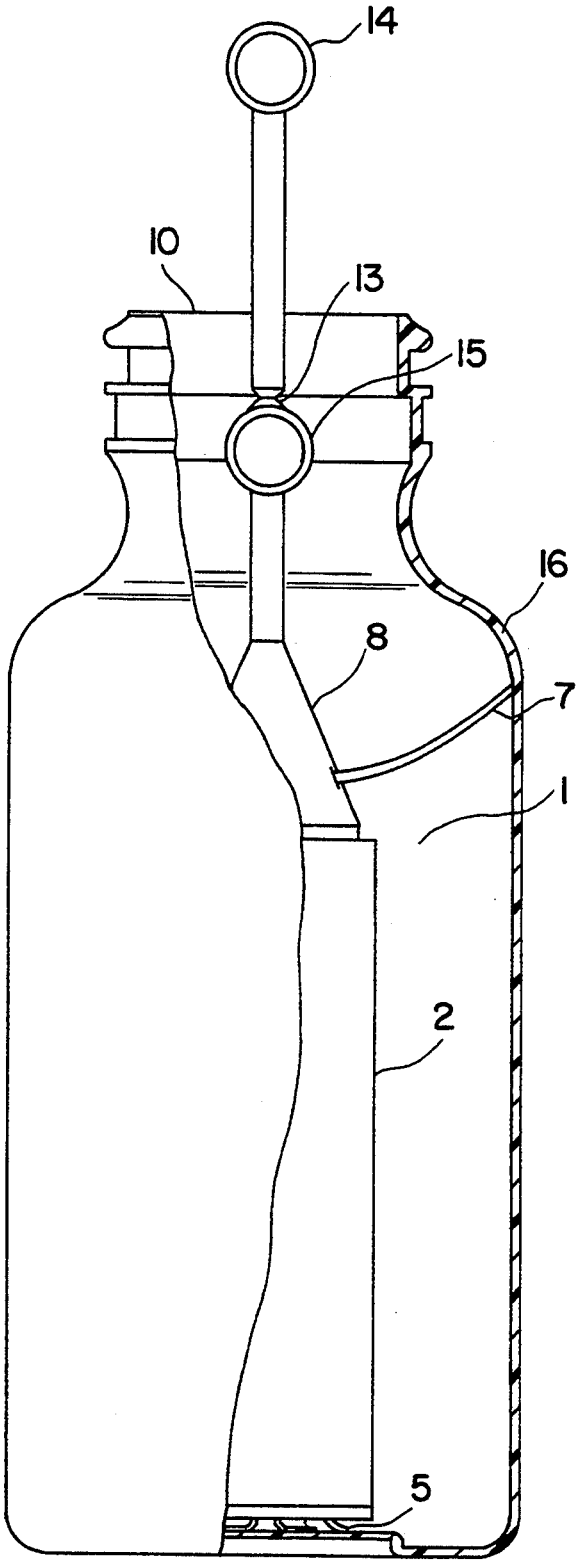
FIG. 8 is a sectional view of the completed insert fit in a common 21 ounce sport bottle. In this scenario, the stem is cut just above the lower tab grip.

FIG. 1 illustrates a sectional view of the stem section 12 which allows easy insertion into and removal from common beverage containers. The diameter of the stem is determined by the strength characteristics required for insertion and removal. In the preferred design, the stem diameter is between ⅛" and ¾". A notch 13 indicating a location to cut the stem for use in small water bottles is incorporated into the design. Location of the notch along the length of the stem is determined by the height dimension of common small beverage containers on the market, typically 3¼" to 7" from the bottom of the insert. Grip tabs are located along the length of the stem. In the preferred method, two tabs 14 and 15 are used to grip the insert during insertion and removal from large and small bottles, respectively. A slight indentation in the surface of the tabs improves ability to grip the insert during insertion and removal. A textured tab is optional. Diameter of the face of the tab is determined by the size of the human index finger and thumb. The preferred face diameter is 3/16" to ¾". FIGS. 7 and 8 show the insert placed inside common beverage containers used by outdoors, bicycle and fitness enthusiasts. The stem is maintained at full length for use in large bottles such as the one in FIG. 7. To fit the shorter bottle shown in FIG. 8, the stem is cut at the notch 13 just above the lower tab grip 15. In the preferred design, the top point of the lower tab grip is located between 3¼" and 7" from the bottom of the insert. The top point of the top-most tab grip in the preferred method is between 3¼" and 11" from the bottom of the insert. This feature allows manufacture of a single size insert which fits tall and short bottles. There is no need to produce multiple sizes for sale. The user can customize the height of the insert as desired by cutting the stem to the desired length.

Based on reduction to practice of the preferred implementation method, the following claims are made:

1. A tube open at one end and closed at the other, means sealing said end of the tube In a manner to prevent the passage of liquid therethrough and a freezable refrigerant material within the tube, where said refrigerant material and tube provide means to cool a liquid in which said tube is immersed, said tube comprising a plurality of symmetrically disposed flexible, resilient, radially extending stabilizing fin assemblies, thereby providing means to selectively removably retain said tube in containers of various shape and size.

2. A tube according to claim 1 further comprising:

a. a weld sealing a plug to the open end of the tube;

b. a plurality of flexible, resilient shock absorbing fins attached to the bottom end of said plug;

c. a handle means attached to top end of said container;

d. a plurality of notches in said handle providing means to sever handle at various points along its vertical axis;

e. a conical section with said flexible, resilient, radially extending stabilizing fin assemblies disposed about said conical section providing means to optimize the volume of refrigerant material Inside said tube and providing predetermined tube diameter for optimum flexibility of said fins.

3. A tube and container according to claim 1, wherein said container further comprises a side wall having a shoulder radius and wherein said radially extending flexible resilient fin assemblies comprise means to engage said shoulder radius.

4. A tube and container according to claim 2, wherein said container further comprises a side wall having a shoulder radius and wherein said radially extending flexible resilient fin assemblies comprise means to engage said shoulder radius.

5. The method of chilling or retaining chilled, a body of liquid contained In a container having a selectively closable opening, a bottom wall and side wall defining the hollow interior of the container, comprising the steps of:

a. arranging the empty container to enable access to the closable opening;

b. Inserting through said closable opening a tube within which is enclosed a body of frozen or chilled refrigerant material, said tube enclosing said body of frozen or chilled refrigerant material being provided with a plurality of symmetrically disposed flexible, resilient, radially extending flexible resilient stabilizing fin assemblies;

c. arranging said tube after insertion into said empty container so that said plurality of radially extending flexible resilient fins impinge resiliently against the side walls of said container;

d. filling said container through sold opening with a liquid to be chilled or maintained chilled;

e. thereafter closing said opening In said container to retain the liquid to be chilled or maintained chilled within the container, sold liquid able to flow freely around said inserted tube and through the opening of said container.

6. The method according to claim 5 with the tube further comprising a plurality of flexible, resilient shock absorbing fins which impinge resiliently against the inside bottom of said container.

* * * * *